US010569845B1

(12) United States Patent
Araki et al.

(10) Patent No.: US 10,569,845 B1
(45) Date of Patent: Feb. 25, 2020

(54) PERSONAL WATERCRAFT

(71) Applicant: KAWASAKI JUKOGYO KABUSHIKI KAISHA, Kobe-shi, Hyogo (JP)

(72) Inventors: Toshio Araki, Kakogawa (JP); Hironori Kato, Kakogawa (JP); Hiroshi Yagii, Himeji (JP)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 0 days.

(21) Appl. No.: 16/110,196

(22) Filed: Aug. 23, 2018

(51) Int. Cl.
*B63B 35/73* (2006.01)
*B63B 35/81* (2006.01)

(52) U.S. Cl.
CPC ..... *B63B 35/81* (2013.01); *B63B 35/731* (2013.01)

(58) Field of Classification Search
CPC ... B63B 35/73; B63B 35/731; B63B 2035/73; B63B 35/81; B63B 2035/81
USPC ..... 114/55.5, 55.51, 55.53, 55.57, 343, 361, 114/364
See application file for complete search history.

(56) References Cited

U.S. PATENT DOCUMENTS 5,664,515 A * 9/1997 Hattori ..... B63J 2/06 114/211
6,205,942 B1 * 3/2001 Tsumiyama ..... B63B 3/56 114/357
8,555,799 B2 10/2013 Otsuka et al.
9,873,498 B2 * 1/2018 Araki ..... B63B 35/731

* cited by examiner

*Primary Examiner* — Daniel V Venne
(74) *Attorney, Agent, or Firm* — Alleman Hall Creasman & Tuttle LLP

(57) ABSTRACT

A personal watercraft includes a recess formed in a deck and a lid member having a mesh-like appearance and made of elastic members crossing each other, wherein the lid member is removably attached to cover an opening of the recess. The recess is formed in a seat supporting section configured to support a seat for an operator to sit during an operation.

5 Claims, 5 Drawing Sheets

PERSONAL WATERCRAFT

BACKGROUND OF THE INVENTION

Field of the Invention

The present invention relates to a personal watercraft configured to be operated on the water by an operator.

Description of Related Art

Some of personal watercrafts include a storage for storing an object or objects such as a wakeboard rope used mainly at the rear of a watercraft body (hereinafter, referred to simply as "body"). U.S. Pat. No. 8,555,799 discloses such a personal watercraft. U.S. Pat. No. 8,555,799 discloses a storage formed at a position posterior to a position of an operator.

However, the storage of the personal watercraft disclosed in U.S. Pat. No. 8,555,799 includes a lid for covering an opening of the storage, and the lid is configured to be openable and closable via a hinge. The storage only accommodates a quantity of the object or objects corresponding to a capacity of an interior of the storage with the lid closed. Therefore, the capacity of the storage is limited.

In view of such circumstances, it is an object of the present invention to provide a personal watercraft capable of accommodating an object or objects having a larger volume in a storage.

SUMMARY OF THE INVENTION

An object of the present invention is to provide a personal watercraft capable of accommodating an object or objects having a larger volume in a storage.

A personal watercraft according to an aspect of the present invention includes a recess formed in a deck and a lid member having a mesh-like appearance and made of elastic members crossing each other, in which the lid member is removably attached to cover an opening of the recess, and the recess is formed in a seat supporting section configured to support a seat for an operator to sit during an operation.

In this configuration, an object is stored in the interior of the recess and is covered with the lid member having the mesh-like appearance and made of the elastic members crossing each other. Therefore, even when an object having a large volume such as protruding from the recess, the lid member stretches to allow the object to be accommodated in the storage. Therefore, the personal watercraft may provide a storage capable of accommodating an object or objects having a larger volume and thus provide an improved user friendliness. The recess is formed in the seat supporting section, and thus the seat supporting section serves both as a structure for supporting the seat and as a structure for forming the recess. Accordingly, a reduction in size of the personal watercraft is achieved.

DETAILED DESCRIPTION OF THE PREFERRED EMBODIMENTS

Hereinafter, an embodiment of the present invention will be described with reference to the drawings.

Figure 1:
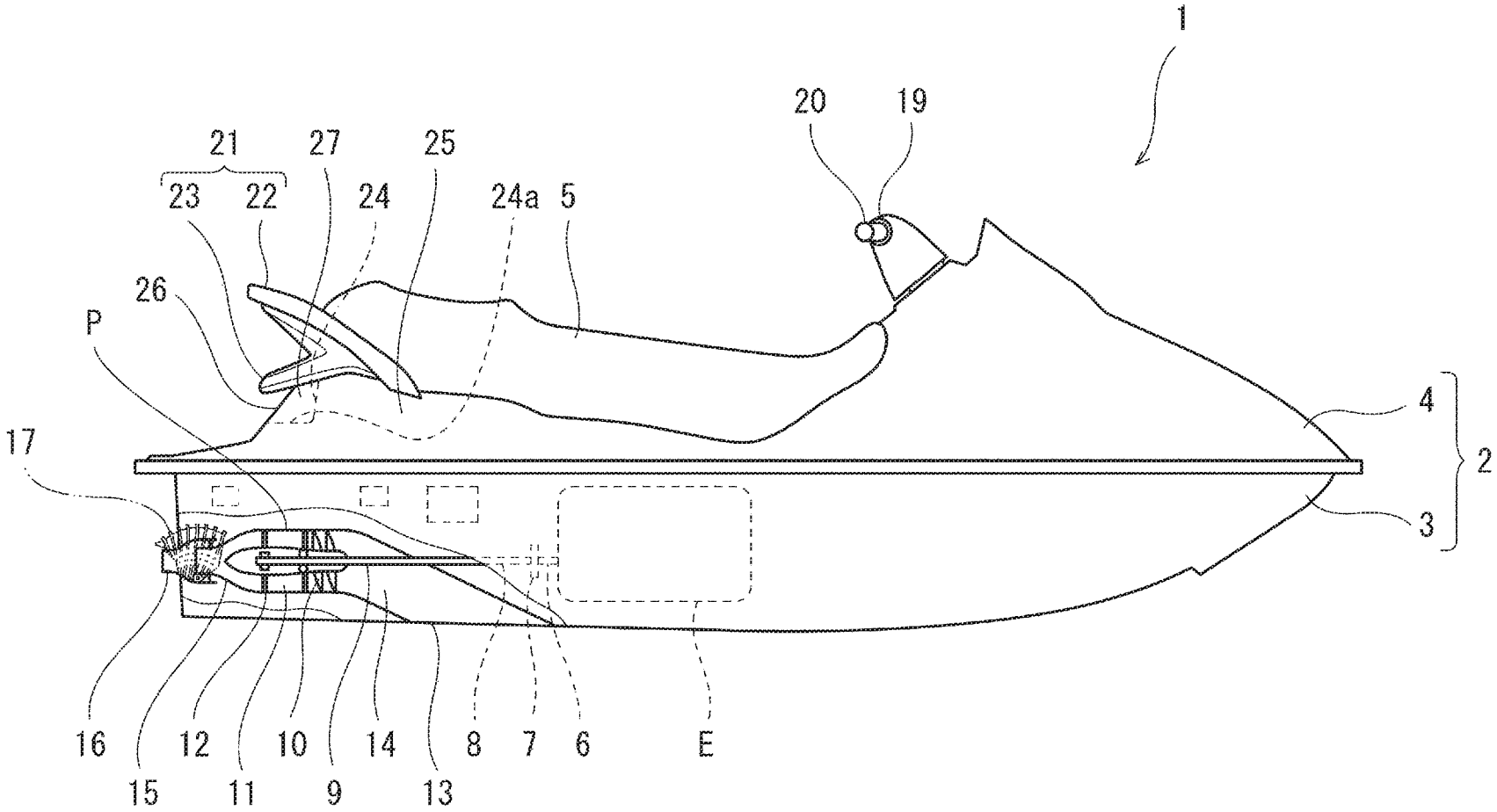
FIG. 1 is a side view of a personal watercraft, partly broken, according to an embodiment.

FIG. 1 is a side view of a personal watercraft 1, partially broken, according to an embodiment. As illustrated in FIG. 1, the personal watercraft 1 includes a body 2, and the body 2 includes a hull 3 and a deck 4 that covers the hull 3 from the top. The personal watercraft 1 includes a seat 5 on the body 2 and is operated by an operator sitting astride on the seat 5. An engine E, which is an example of a prime mover, is accommodated in an interior space of the body 2.

An output shaft 6 of the engine E extends rearward in the body 2. An output end of the output shaft 6 is coupled to a propeller shaft 8 via a coupling member 7. A waterjet pump P is disposed in the rear portion of the hull 3 at a center in a lateral direction, and the propeller shaft 8 is coupled to a pump shaft 9 of the waterjet pump P. In other words, the pump shaft 9 rotates in conjunction with the rotation of the output shaft 6. The pump shaft 9 is provided with an impeller 10, and a stator vane 11 is provided at a position posterior to the impeller 10. The impeller 10 is covered with a pump casing 12 having a cylindrical shape, and the pump casing 12 surrounds the impeller 10.

A water intake 13 opens in the bottom of the body 2. The water intake 13 and the pump casing 12 are in communication with each other via a water passage 14. A pump nozzle 15 is provided at the rear section of the body 2 and connected to the pump casing 12. The pump nozzle 15 has a diameter decreasing rearward, and includes a jetting port at a rear end. A steering nozzle 16 is secured to the jetting port of the pump nozzle 15 by a lateral pivotal connection.

The personal watercraft 1 pressurizes and accelerates water taken through the water intake 13 in the bottom of the hull 3 by a rotational force of the impeller 10 of the waterjet pump P driven by the engine E. The stator vane 11 rectifies the flow of the water and causes the water to be jetted rearward from a jetting port of the pump nozzle 15 through the steering nozzle 16. In other words, a reaction force of the water jetted from the waterjet pump P through the steering nozzle provides the personal watercraft 1 with a propulsive force.

A handle bar 19 to be gripped by an operator for steering the personal watercraft 1 is provided on a front part of the deck 4. Handle grips 20 are fitted on the handle bar 19. An operation device (not illustrated) is provided on at least one of the handle grips 20. The operator may operate the operation device for advancing and accelerating the personal watercraft 1. The handle bar 19 is connected to the steering nozzle 16 via a steering cable (not illustrated). The steering nozzle 16 pivots rightward and leftward in conjunction with rightward and leftward turning operations of the handle bar 19. The direction of advancement of the personal watercraft 1 may be changed by the pivotal motion of the steering nozzle 16, and in this manner, the steering of the personal watercraft 1 is achieved.

A rear grip member 21 is provided on the deck 4 at a position posterior to the seat 5 to allow a passenger (user) to grip with his or her hand for clambering up on the deck 4 out of the water. In the embodiment, the rear grip member 21 is attached to a seat supporting section 25 configured to support the seat 5. When a passenger clambers up on the rear section of the personal watercraft 1 or get off the rear section of the personal watercraft 1, the passenger may grip the rear grip member 21 for supporting the his or her body during actions of clambering up and getting off.

The rear grip member 21 includes an upper grip portion 22 provided on an upper part and a lower grip portion 23 provided at a position lower than the upper grip portion 22. When the passenger in the water climbers up onto the deck 4, the passenger may grip the lower grip portion 23 first, and then grip the upper grip portion 22 to lift up the body step-by-step onto the deck 4. In contrast, when the passenger gets off the deck 4 into the water, the passenger grips the upper grip portion 22 first and then grips the lower grip portion 23 to lower the position of his or her body step-by-step.

The deck 4 also includes a recess 24 downward of the rear grip member 21. The recess 24 is formed in the seat supporting section 25 for supporting the seat 5 for the operator to sit. In the embodiment, the recess 24 is formed in the seat supporting section 25 at a position facing rearward of the body 2. The opening of the recess 24 is covered with a lid member 26. A space between the recess 24 and the lid member 26 is used as a storage space (storage) 27 for storing an object.

Figure 2:
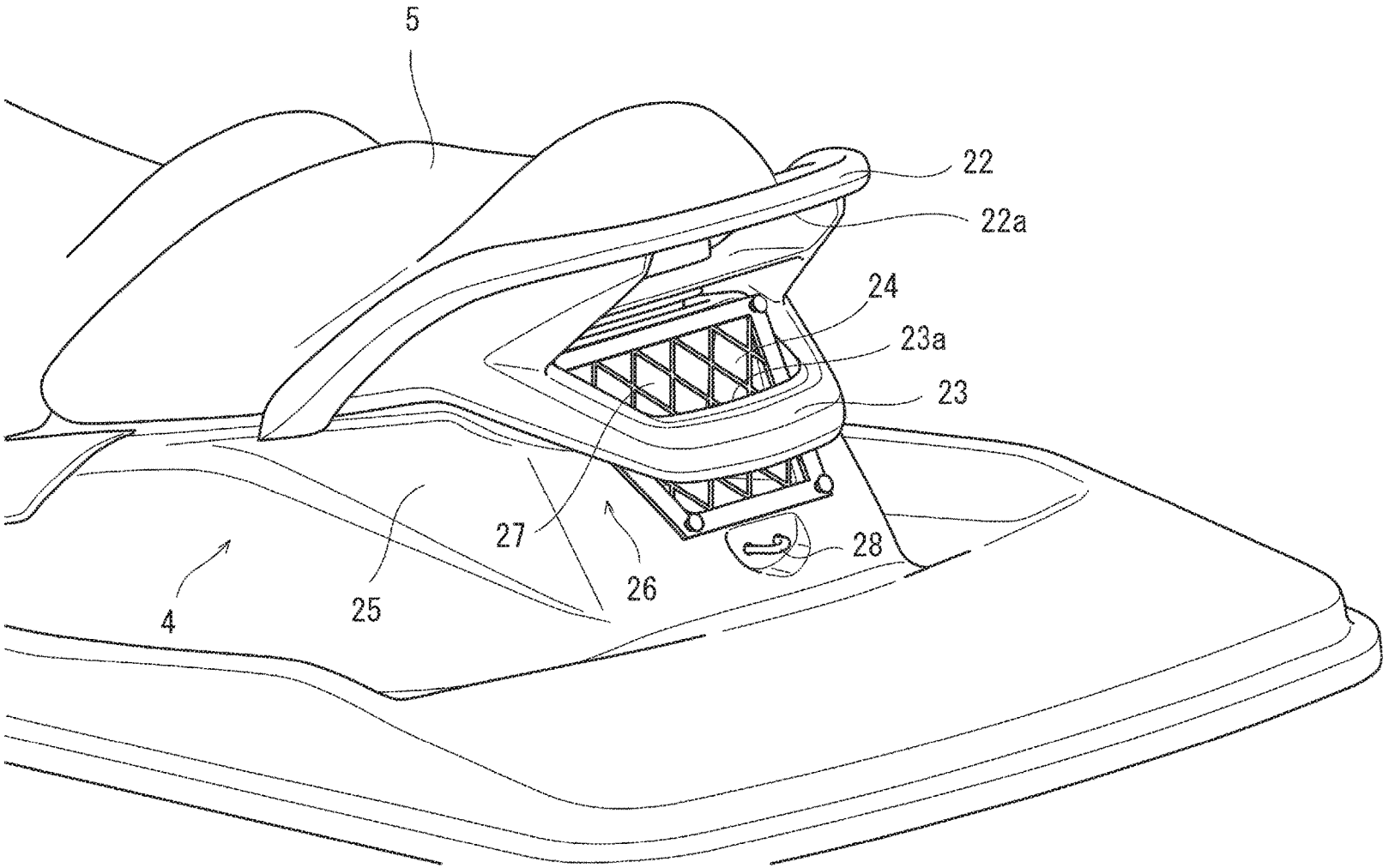
FIG. 2 is a perspective view of the personal watercraft in FIG. 1 illustrating a rear section of a deck.

FIG. 2 is an enlarged perspective view of a rear section of the body 2. In the embodiment, the upper grip portion 22 and the lower grip portion 23 are formed integrally. A through opening 22*a* is formed at a center of the upper grip portion 22 in the width direction. A through opening 23*a* is formed at a center of the lower grip portion 23 in the width direction. As the through openings 22*a* and 23*a* are formed at the centers of the upper grip portion 22 and the lower grip portion 23 in the width direction, the upper grip portion 22 and the lower grip portion 23 are respectively formed into shapes easy to grip for passengers.

The upper grip portion 22 and the recess 24 is configured such that when the upper grip portion 22 is viewed from above in plan view, the recess 24 is included within the through opening 22*a* formed in the upper grip portion 22. The lid member 26 is attached to the outside of the recess 24 and covers the opening of the recess 24. The recess 24 is formed in the deck 4 at a position overlapping with the lower grip portion 23 when viewing the body 2 from the rear.

A relatively large space is formed between the upper grip portion 22 and the lower grip portion 23. A passenger is allowed to access the recess 24 by inserting a hand into the space between the upper grip portion 22 and the lower grip portion 23.

A hooking member 28 configured to hang a linear member such as a rope on is provided on the seat supporting section 25 at a position below the recess 24. In other words, the recess 24 is formed at a position proximity to the hooking member 28. In the embodiment, the hooking member 28 is a U-shaped pipe made of a metal.

The location of the recess 24 formed at the position proximity to the hooking member 28 allows the user to store the linear member such as the rope easily in the interior of the storage space 27. Therefore, the personal watercraft 1 can be provided with improved user friendliness. The wire member is used for the wakeboard, for example, by being hung on the hooking member 28. For example, when the rope stored in the storage space 27 is hung on the hooking member 28 for use, the rope taken out from the storage space 27 may be hung directly on the hooking member 28, and thus the passenger does not have to carry the rope long distances. Likewise, when the user stores the rope hung on the hooking member 28 in the storage space 27 after the usage of the rope, the rope taken out from the hooking member 28 may be stored directly into the storage space 27, and thus the passenger does not have to carry the rope long distances. In addition, in the embodiment, the location of the recess 24 formed immediately below the hooking member 28 allows the rope to be stored with one end hung on the hooking member 28 and remaining part of the rope stored in the interior of the storage space 27, that is, without detaching the one end hung on the hooking member 28 from the hooking member 28.

Figure 3:
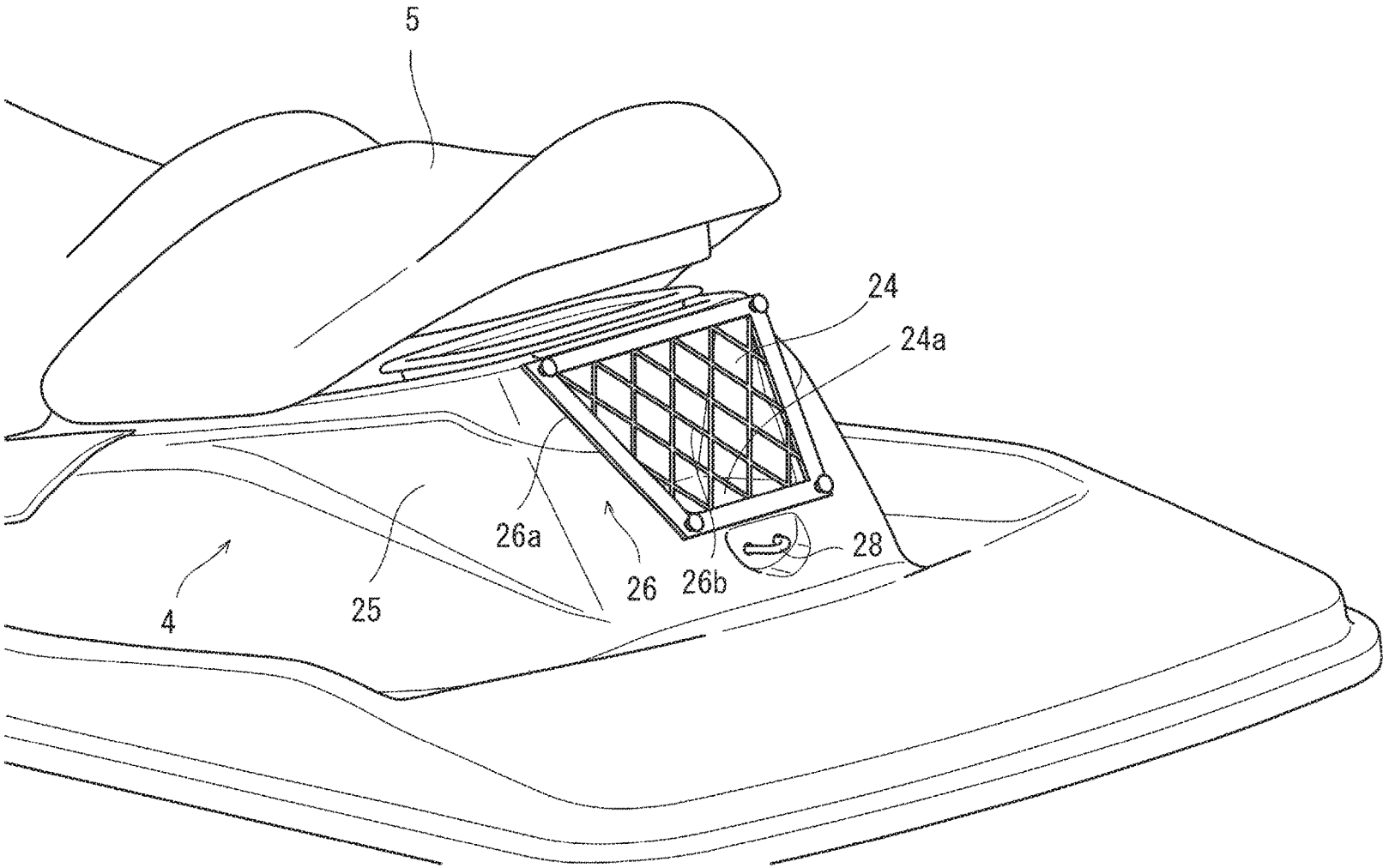
FIG. 3 is a perspective view of the personal watercraft in FIG. 1 illustrating a rear section of the deck with a rear grip member removed.

FIG. 3 is a perspective view of the rear section of the deck 4 with the rear grip member 21 removed. As illustrated in FIG. 3, in the embodiment, the lid member 26 is formed in substantially conformance with the shape of the opening of the recess 24. The lid member 26 includes a frame portion 26*a* disposed on the outer side and formed into a square frame shape and a mesh portion 26*b* formed into a mesh appearance inside the frame portion 26*a*.

The lid member 26 is made of elastic members such as rubber strips formed into a linear shape. In the embodiment, the lid member 26 is made of ethylene propylene rubber (EPDM). The lid member 26 is formed to have a mesh-like appearance in the mesh portion 26*b* by the elastic members 26*b* crossing each other. The lid member 26 is removably attached to the deck 4.

Since the lid member 26 includes the mesh portion 26*b*, even when a wet object is stored in the interior of the storage space 27, water may be drained through openings formed in the mesh portion 26*b* between the elastic members 26*b* crossing each other. In addition, since the interior of the storage space 27 is exposed to the outside air through the holes formed in the mesh portion 26*b* between the elastic members 26*b* crossing each other, the stored object in the interior of the storage space 27 may be quickly dried. The storage space 27 may store an object such as the rope used by being hung on the hooking member 28 or gloves used by an operator. Even if the stored object is wet, the water contained in the stored object may be vaporized in the interior of the storage space 27 to dry the wet object. In this manner, even the wet object may be stored in the interior of the storage space 27 defined by the recess 24 and the lid member 26 according to the embodiment.

In the embodiment, a drain hole (not illustrated) is formed in the frame portion 26*a* of the lid member 26. When the wet object is stored in the storage space 27, water may be drained from the storage space 27 through the drain hole. Therefore, the water contained in the stored object may be drained efficiently from the storage space 27.

Figure 4:
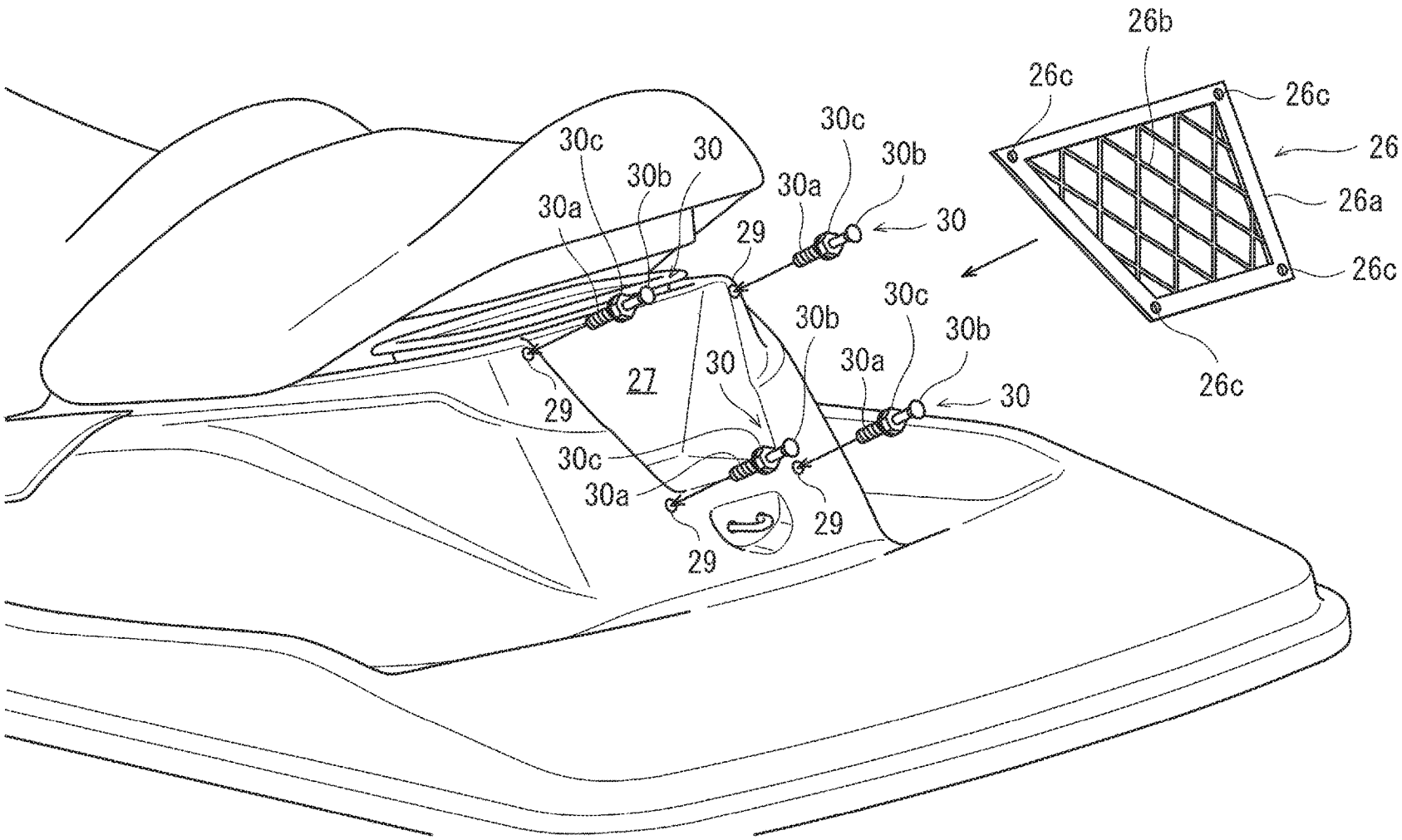
FIG. 4 is an explanatory drawing of the personal watercraft in FIG. 1 for explaining how to mount a lid member to the deck.

FIG. 4 is an explanatory drawing for explaining mounting of the lid member 26. A plurality of pins 30 are attached to the deck 4. Each of the pins 30 has a screw thread 30*a*. Holes 29 are formed in the deck 4 at positions to attach the pins 30. Each of the holes 29 has a screw groove on an inner periphery. Part of the pin 30 having the screw thread 30*a* is inserted into the hole 29 in the deck 4 to attach the pin 30 to the deck 4. The pin 30 is provided with a volt member 30*c* to aid, after insertion into each of the holes 29 for easy attachment via a screwing mechanism.

The part of the pin 30 at a distal end opposite to the part having the screw thread 30*a* is provided with an enlarged diameter portion 30*b*. The enlarged diameter portion 30*b* is formed to have a diameter increasing from the portion of the pin 30 having the screw thread 30*a* to the other end. The lid member 26 is provided with insertion holes 26*c* each for receiving the enlarged diameter portion 30*b* of the pin 30.

When the lid member 26 is attached to the deck 4, the lid member 26 is brought into proximity to the recess 24 with the insertion holes 26*c* in the lid member 26 aligned with corresponding pins 30. When the pins 30 on the deck 4 come into contact with the insertion holes 26*c*, the lid member 26 is further pushed toward the enlarged diameter portions 30*b* of the pins 30 to make the enlarged diameter portions 30*b* of the pins 30 be inserted into the insertion holes 26*c*. The enlarged diameter portions 30*b* are then allowed to pass through the insertion holes 26*c* with the lid member 26 deformed. Accordingly, the pins 30 are inserted into the insertion holes 26*c*, and the lid member 26 is attached to the deck 4. Since the lid member 26 is formed of the elastic members 26*b*, the enlarged diameter portions 30*b* is allowed to be inserted into the insertion holes 26*c* by pushing the lid member 26 against the pins 30 even when the enlarged diameter portions 30*b* are larger than the insertion holes 26*c*.

Figure 5:
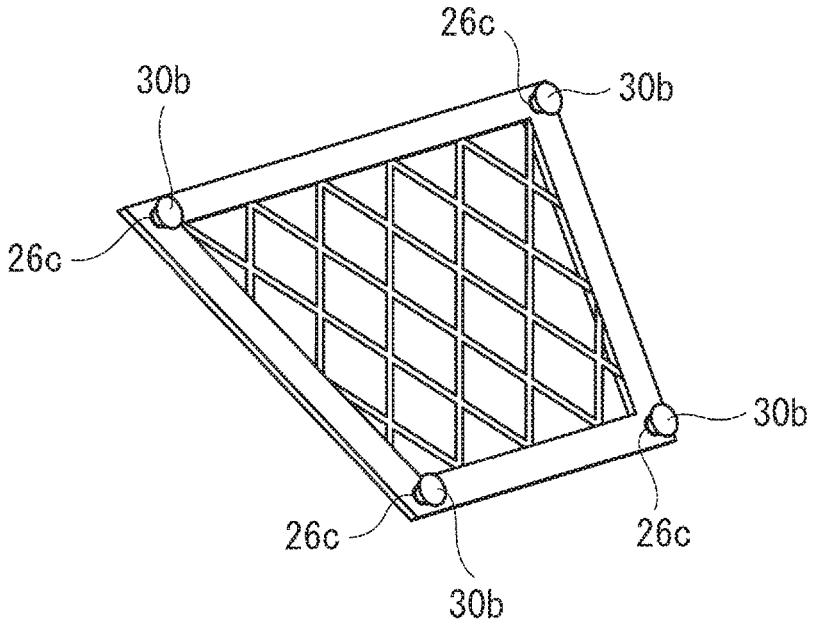
FIG. 5 is a perspective view of the lid member attached to the deck illustrated in FIG. 4.

FIG. 5 is a perspective view illustrating the lid member 26 attached to the deck 4. The lid member 26 may be attached to the deck 4 by inserting the enlarged diameter portions 30*b* of the pins 30 into the corresponding insertion holes 26*c*. Each of the enlarged diameter portion 30*b* is formed to have a diameter increasing from the portion having the screw thread 30*a* to the opposite end. Therefore, once the enlarged diameter portions 30*b* are inserted into the insertion holes 26*c*, the lid member 26 does not come off unless a large force to some extent is applied to a direction to detach the lid member 26. Therefore, once the lid member 26 is attached to the deck 4, the lid member 26 stays attached continuously to the deck 4 unless a large force to some extent is applied. Accordingly, the object stored in the interior 24*a* of the recess 24 is reliably protected by being covered with the lid member 26.

Since the object is stored in the storage space 27 between the recess 24 and the lid member 26 configured as described above, attachment and removal of the lid member 26 is easily achieved. Therefore, storage of the object into the storage space 27 or taking out of the object from the storage space 27 are easily achieved.

The object is stored in the interior 24*a* of the recess 24 covered with the lid member 26 having the mesh-like appearance and made of the elastic members 26*b* crossing each other. Therefore, even when an object has a large volume and thus protrudes from the recess 24, the lid member 26 stretches to allow such an object to be accommodated in the storage space 27. Therefore, the storage space 27 is capable of accommodating an object having a larger volume. Accordingly, with the storage space 27 configured by using the recess 24 and the lid member 26 having the configurations described above, the user friendly personal watercraft 1 is achieved.

In addition, as descried above, since the recess 24 is formed in the seat supporting section 25, the seat supporting section 25 serves both as a structure for supporting the seat 5 and as a structure for forming the recess 24. Accordingly, a reduction in size of the personal watercraft 1 is achieved. In the embodiment, the recess 24 is formed in the seat supporting section 25 at a position facing rearward, and thus the passenger does not have to carry the object long distances for using the stored object at the rear section of the body 2. Accordingly, inconvenience that the passenger may feel is prevented or reduced.

In particular, when a wet object is stored in the interior of the storage space 27, the passenger is obliged to carry the wet and thus heavy object to the storage space 27. If the storage space 27 is provided at a position far from the position of usage, the passenger is obliged to carry the wet and thus heavy object relatively long distances from the position of usage to the storage space 27, and thus may suffer from such a troublesome task. In the embodiment, the recess 24 is formed in the seat supporting section 25 at a position facing rearward, and thus the passenger does not have to carry the object long distances. Therefore, the passenger is not obliged to carry a heavy object long distances, and thus the personal watercraft 1 with improved user friendliness is achieved.

When the body 2 is viewed from the rear, the recess 24 is formed at a position overlapping with the lower grip portion 23. Therefore, the storage space 27 is hidden behind the lower grip portion 23, and the storage space 27 may be made less noticeable. Therefore, even when the passenger stores an object in the storage space 27 in a disordered manner, it is not noticeable by surroundings. Accordingly, the passenger may store the object in the storage space 27 in a disordered manner without being sensitive to be noticed by surroundings. Accordingly, the personal watercraft 1 with further improved user friendliness is achieved. Also, since the storage space 27 is hidden by the lower grip portion 23, even when the object stored in the interior of the storage space 27 is dirty, it may be made less noticeable by surroundings.

Since the lower grip portion 23 includes the through opening 23*a* penetrating in the vertical direction at a position overlapping with the lid member 26 when viewed from above, the storage space 27 is hidden by the lower grip portion 23 but easy access to the lid member 26 from above is provided for the passenger. Therefore, the personal watercraft 1 with still further improved user friendliness is achieved. In the embodiment, the upper grip portion 22 also includes the through opening 22*a* penetrating in the vertical direction at a position overlapping with the lid member 26 when viewed from above. Therefore, the passenger is allowed to access the storage space 27 via the through opening 22*a* of the upper grip portion 22 and the through opening 23*a* of the lower grip portion 23. Accordingly, the passenger is allowed to access the storage space 27 further easily.

For attaching the lid member 26 to the deck 4, the enlarged diameter portions 30*b* may be passed through the insertion hole 26*c* with the lid member 26 deformed and thus the pins 30 are inserted into the insertion holes 26*c*. Therefore, attachment and removal of the lid member 26 to the deck 4 is easily achieved. Accordingly, storage of an object and taking out of the stored object are achieved with less effort, and thus the personal watercraft 1 with improved user friendliness is achieved.

In the embodiment, the configuration of the personal watercraft 1 including the rear grip member 21 on the seat supporting section 25 has been described. However, the present invention is not limited to the mode described in the embodiment. The rear grip member 21 does not necessarily be provided.

In the embodiment, the configuration of the rear grip member 21 including the upper grip portion 22 and the lower grip portion 23 has been described. However, the present invention is not limited to the mode described in the embodiment. The rear grip member 21 may be provided only one of the upper grip portion 22 and the lower grip portion 23. The rear grip member 21 may include a rear grip portion other than the upper grip portion 22 and the lower grip portion 23, and a configuration having three or more rear grip portions in total may be provided.

In the embodiment, the configuration in which the through openings 22*a* and 23*a* are provided respectively on the upper grip portion 22 and the lower grip portion 23 has been described. However, the present invention is not limited to the mode described in the embodiment. The through opening may be formed on only one of the upper grip portion 22 and the lower grip portion 23. If the upper and lower grip portions 22 and 23 have configuration such that the passenger can grip easily, the through opening may not be provided on both of the upper grip portion 22 and the lower grip portion 23.

In the embodiment described above, the configuration in which the seat supporting section 25 is provided with the hooking member 28 configured to hang the linear member such as a rope on has been described. However, the present invention is not limited to the mode described in the embodiment. The hooking member 28 may not be provided on the seat supporting section 25. The hooking member 28 may not be provided at a position in proximity to the storage space 27. The personal watercraft 1 may not include the hooking member 28.

In the embodiment, the configuration in which the lid member 26 is attached to the deck 4 by inserting the pins 30 attached to the deck 4 into the insertion holes 26*c* formed in the lid member 26 has been described. However, the mode of mounting the lid member 26 of the present invention is not limited to the mode described in the embodiment. The mode of mounting the lid member 26 to the deck 4 may have other configuration. Mounting of the lid member 26 to the deck 4 preferably allows easy attachment and removal.

In the embodiment, the configuration of the recess 24 being provided at a position overlapping with the lower grip portion 23 when the body 2 viewed from the rear has been described. However, the present invention is not limited to the embodiment, and the recess 24 may be a position not overlapping with the lower grip portion 23 or the upper grip portion 22. The storage space 27 may be provided at a position at a distance from the rear grip member 21.

In the embodiment, water accumulated in the storage space 27 is drained out through the drain hole formed in the frame portion 26*a* of the lid member 26. However, the present invention is not limited to the mode described in the embodiment. Water may be drained out from the storage space 27 through a drain hole formed in the interior of the storage space 27 in communication with the outside.

In the embodiment, the recess 24 is formed in the seat supporting section 25 at a position facing the rearward of the body 2. However, the present invention is not limited to the mode described in the embodiment. The recess 24 may be formed in the seat supporting section 25 at a position other than the position facing rearward of the body 2. In other words, the recess 24 may be formed at any position of the seat supporting section 25 configured to support the seat 5. For example, the recess 24 may be formed in the seat supporting section 25 at a position facing sideward of the body 2.

What is claimed is:

1. A personal watercraft comprising:

a recess formed in a deck: and a lid member having a mesh appearance and made of elastic members crossing each other, wherein the lid member is removably attached to cover an opening of the recess, the recess is formed in a seat supporting section configured to support a seat for an operator to sit during an operation, the seat supporting section includes a rear grip member, the rear grip member includes an upper grip portion and a lower grip portion provided at a position lower than the upper grip portion, and the recess is formed at a position overlapping with the lower grip portion when a body is viewed from a rear.

2. The personal watercraft according to claim 1, wherein the recess is formed in the seat supporting section at a position facing rearward of the body.

3. The personal watercraft according to claim 1, wherein the lower grip portion includes a through opening penetrating in a vertical direction at a position overlapping with the lid member when the body is viewed from above.

4. The personal watercraft according to claim 1, wherein the seat supporting section includes a hooking member, and the recess is formed at a position in proximity to the hooking member.

5. The personal watercraft according to claim 1, comprising:

a pin having an enlarged diameter portion at an end, the pin being attached to the deck; and an insertion hole formed in the lid member, wherein the lid member is attached to the deck to cover the recess by allowing the enlarged diameter portion to pass through the insertion hole with the lid member being deformed, and inserting the pin into the insertion hole.

* * * * *